US012678847B1

(12) United States Patent
Puippe et al.

(10) Patent No.: US 12,678,847 B1
(45) Date of Patent: Jul. 14, 2026

(54) METHOD FOR OBTAINING A COMPONENT MADE OF A PALLADIUM-INDIUM ALLOY HAVING A GOOD WORKABILITY

(71) Applicant: Jean-Claude Puippe, St Maurice VS (CH)

(72) Inventors: Jean-Claude Puippe, St Maurice VS (CH); Ulrich Klotz, Schwäbisch Gmünd (DE)

(73) Assignee: Jean-Claude Puippe, St Maurice VS (CH)

( * ) Notice: Subject to any disclaimer, the term of this patent is extended or adjusted under 35 U.S.C. 154(b) by 0 days.

(21) Appl. No.: 19/016,607

(22) Filed: Jan. 10, 2025

(51) Int. Cl.
*B21C 23/00* (2006.01)
*C22C 5/04* (2006.01)

(52) U.S. Cl.
CPC ..... *B21C 23/002* (2013.01); *B21C 23/001* (2013.01); *C22C 5/04* (2013.01)

(58) Field of Classification Search
CPC ..... B21C 23/001; B21C 23/002; B21J 1/003; C22C 5/04
See application file for complete search history.

(56) References Cited

U.S. PATENT DOCUMENTS 4,804,517 A * 2/1989 Schaffer ..... C22C 30/00 420/580
4,911,762 A * 3/1990 Steinemann ..... C22C 5/02 148/426
4,992,297 A * 2/1991 van der Zel ..... C22C 5/06 420/463
6,274,802 B1 * 8/2001 Fukuda ..... H10N 10/01 136/238
9,194,024 B1 * 11/2015 Butler ..... A44C 25/00
2014/0170598 A1 * 6/2014 Abend ..... B22F 10/28 420/588
2014/0314617 A1 * 10/2014 Park ..... C22C 19/07 420/466

OTHER PUBLICATIONS

KR 20130099374A, Lee et al. Sep. 2013.*
CN 114086021A, Lin et al. Feb. 2022.*
Translation CN 114086021A, Lin et al. Feb. 2022.*

* cited by examiner

*Primary Examiner* — Edward T Tolan
(74) *Attorney, Agent, or Firm* — BLANK ROME LLP

(57) ABSTRACT

The present disclosure concerns a method for obtaining a component made of a palladium (Pd)-indium (In) alloy comprising between 46 and 56 wt % Pd, between 44 and 54 wt % In, between 0 and 10 wt % of silver (Ag), gold (Au), platinum (Pt), silicium (Si), or tin (Sn), or a combination of these elements, between 0 and 2 wt % of a grain refiner, between 0 and 5 wt % of aluminum (Al), and a maximum of 1.5 wt % of other elements. The method comprises the steps of providing the Pd—In alloy, and thermomechanical processing the Pd—In alloy with hot pressing at a heating temperature between 1050° C. and 1150° C., at controlled deformation rate of 0.1 to 100 mm/h with an applied load between 1 and 500 MPa, and with a deformation ratio between 1.2 and 15.

11 Claims, 6 Drawing Sheets

(a)

(b)

(c)

(d)

(e)

(f)

(d)

(e)

(f)

METHOD FOR OBTAINING A COMPONENT MADE OF A PALLADIUM-INDIUM ALLOY HAVING A GOOD WORKABILITY

TECHNICAL DOMAIN

The present disclosure concerns a method for obtaining a component made of a palladium (Pd)-indium (In) alloy. The component obtained by the method has a good workability.

RELATED ART

Pd-based alloys have wide applications in jewelry and goldsmithing for the manufacture of jewelry, household utensils, objects for domestic use, etc. Pd-based alloys can also be used in the construction of precision equipment and in electronics.

More particularly, alloys based on the intermetallic phase Pd—In show a variety of colors from yellow to pink. Such alloys can be hallmarked "Palladium 500" (or Pd500). Intermetallic Pd—In alloys are generally-brittle, and not suitable for mechanical machining.

SUMMARY

The present disclosure concerns a method for obtaining a component made of a Pd—In alloy comprising between 46 and 56 wt % Pd, between 44 and 54 wt % In, between 0 and 10 wt % of silver (Ag), gold (Au), copper (Cu), platinum (Pt), silicium (Si), or tin (Sn), or a combination of these elements, between 0 and 2 wt % of a grain refiner, between 0 and 5 wt % of aluminum (Al), and a maximum of 1.5 wt % of other elements. The grain refiner comprises any one of: ruthenium (Ru), rhodium (Rh), rhenium (Re) or iridium (Ir). The method comprises providing the Pd—In alloy, and thermomechanical processing the Pd—In alloy. The thermomechanical processing comprises a step of hot pressing including any one of: hot pressing under vacuum, hot pressing under a protective gas, or hot isostatic pressing. The step of hot pressing is performed at a heating temperature between 1050° C. and 1150° C. The step of hot pressing is performed at controlled deformation rate of 0.1 to 100 mm/h with an applied load between 1 and 500 MPa.

The thermomechanical processing further comprises the step of hot pressing performed with a deformation ratio between 1.2 and 15. The deformation is defined as the ratio of the initial lateral size of the component, prior thermomechanically processing the component, to the final lateral size of the component after thermomechanically processing the component.

The thermomechanically processed Pd—In alloy has a bending stress measured with a three-point bending test, according to DIN EN ISO 9693 until breakage that is at least two time greater that the bending stress of as-cast the Pd—In alloy measured with the same three-point bending test.

With respect to what is known in the art, the method disclosed herein allows for obtaining a component that has a good workability at room temperature and at moderate load. Moreover, the obtained component shows no cracking or sample failure.

Here, the term workability can include: machining, milling, drilling, turning, screw-cutting, grinding, lapping, polishing, decorating by mechanical or laser engraving, etc.

SHORT DESCRIPTION OF THE DRAWINGS

Exemplar embodiments of the invention are disclosed in the description and illustrated by the drawings in which:

FIGS. 1*a-f* show SEM micrographs of metallographic cross sections of components in the as-cast condition and made of a Pd—In alloy: 1H (FIG. 1*a*), 2A (FIG. 1*b*), 2B (FIG. 1*c*), 2ABCD (FIG. 1*d*), 2E (FIG. 1*e*), and 2F (FIG. 1*f*), showing the different microstructures depending on the composition;

FIGS. 2*a-f* show SEM micrographs of metallographic cross sections of components made of a Pd—In alloy: 1H (FIG. 2*a*), 2A (FIG. 2*b*), 2B (FIG. 2*c*), 2ABCD (FIG. 2*d*), 2E (FIG. 2*e*), and 2F (FIG. 2*f*), showing the different microstructures depending on the composition, where the components have submitted to a vacuum hot pressing step at a heating temperature of 1100° C.;

Figure 5:
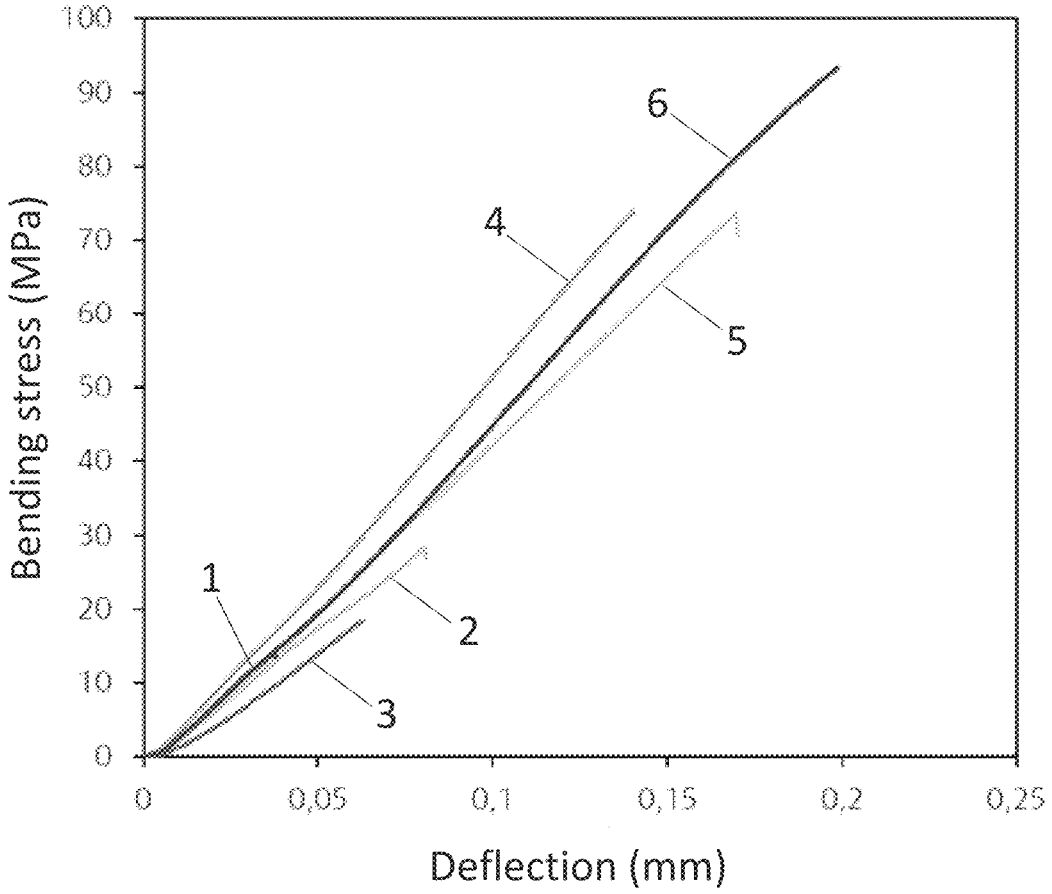

FIG. 5 reports values for the bending stress measured on test components by using a three-point bending test.

EXAMPLES OF EMBODIMENTS

In an embodiment, a component is made of a Pd—In alloy comprising between 46 and 56 wt % Pd, between 44 and 54 wt % In, between 0 and 10 wt % of silver (Ag), gold (Au), copper (Cu), platinum (Pt), silicium (Si), or tin (Sn), or a combination of these elements, between 0 and 2 wt % of a grain refiner, between 0 and 5 wt % of aluminum (Al), and a maximum of 1.5 wt % of other elements. The other elements can comprise Al, C, Co, Hf, Mg, Ni, Sb, Ti, Y, Zn, Zr.

The grain refiner can comprise ruthenium (Ru), rhodium (Rh), rhenium (Re) or iridium (Ir), or a combination of these elements. In an embodiment, the Pd—In alloy comprises between 0.05 and 2 wt % of the grain refiner. For the Pd—In alloy comprises between 0.05 and 2 wt % of Ru.

In another embodiment, the Pd—In alloy can comprise between 1 and 10 wt % silver (Ag).

In yet another embodiment, the Pd—In alloy can comprise between 0.1 and 5 wt % aluminum (Al).

The Pd—In alloy can further comprise between 0.05 and 2 wt % Ru and between 1 and 10 wt % Ag.

The Pd—In alloy can further comprise between 0.05 and 2 wt % Ru and between 0.1 and 5 wt % aluminum (Al).

In a further example, the Pd—In alloy can comprise between 49 and 53 wt % Pd and between 46 and 51 wt % In. Here, the ratio by weight of palladium to indium is between 1.15 and 0.95.

In a further example, the Pd—In alloy can comprise between 50 and 53 wt % Pd and between 46 and 49 wt % In. Here, the ratio by weight of palladium to indium is between 1.15 and 1.02.

In one aspect, the Pd—In alloy can comprise between 0.5 and 2 wt % Al. In another aspect, can comprise between or between 1.5 and 5 wt % Al.

In an embodiment, the Pd—In alloy comprises about 50 wt % of pure Pd. The Pd—In alloy comprising 50 wt % or pure Pd can be hallmarked "Palladium 500" or Pd500, in other words, the Pd—In alloy is a Pd500 alloy.

Also disclosed is a method for preparing the component, comprising the steps of:

providing the Pd—In alloy; and thermomechanical processing the Pd—In alloy.

The thermomechanical processing step can comprise any suitable step of thermomechanical transformation of the Pd—In alloy. For example, the thermomechanical processing step can include performing hot pressing under vacuum (vacuum hot pressing or VHP), hot pressing under a protective gas (such as a noble gas) or of hot isostatic pressing (HIP), hot rolling, extrusion, forging, or continuous casting. More generally, the heating temperature can be between 900° C. or 1000° C. and the melting point of the alloy.

During the step of hot pressing, the component is deformed. The deformation of the component can be characterized by a deformation ratio defined as the ratio of an initial lateral size of the component, prior thermomechanically processing the component, to a final lateral size of the component after thermomechanically processing the component. In the case the component, the initial lateral size can be the diameter of the cylindrical-shaped unprocessed component. Then, the final lateral sizes can be the thickness. The initial and final lateral sizes can be the thickness of the component or the height of the component (for example, in the case of a cylindrical component that is pressed along its length).

The step of hot pressing can be performed at controlled deformation rate of 0.1 to 100 mm/h, typically 0.1 to 10 mm/h, and more specifically 0.5 to 2 mm/h. In one aspect the applied resulting load lies between 1 and 500 MPa, between 5 and 500 MPa, between 10 and 500 MPa, between, between 50 and 500 MPa, between 100 and 500 MPa, between 10 and 400 MPa, between 10 and 300 MPa, between 10 and 200 MPa, or between 10 to 100 MPa. The mechanical press can also be carried out at controlled load in the above-mentioned ranges.

The step of hot pressing can be performed in an electrically heated furnace that is evacuated prior to heating. Heating can be performed at a rate of 5 to 20 K/min up to a heating temperature between 900° C. and 1200° C., or preferably between 1000° C. and 1200° C. At the heating temperature, the Pd—In alloy is ductile. After the heating temperature has been reached, the Pd—In alloy is uniaxially pressed and deformed at the constant heating temperature. After deformation, the component is cooled under vacuum down to 500° C. within approximately one hour and then in free cooling until room temperature is reached.

In one aspect, the step of hot pressing can be performed at a heating temperature between 105° and 1150° C.

The step of hot pressing can be performed at constant deformation rate.

The hot-pressing step comprises extruding thew alloy by passing it through a die, or mold, such as to form a wire having a diameter between 1 and 5 mm. For example, a component having an initial diameter of about 10 mm can be extruded to yield a final diameter of about 4 mm.

In the as-cast condition, the Pd—In alloy typically has irregular grain size with a columnar structure representing up to 50% of the crystal structure. Here, the expression "as-cast condition" has its usual meaning and refers to the Pd—In alloy that has not received finishing or treatment of any kind including heat treatment or hardening treatment, after casting The as-cast Pd—In alloy has coarse-grained and irregular microstructure with grains having different size and shape. Moreover, the microstructure at the surface differs from the microstructure the center of an as-cast Pd—In alloy. The as-cast Pd—In alloy further a significant amount of porosity significantly greater than 1% and shows shrinkage-related porosity. The shrinkage-related porosity is caused by sections of a casting that solidify later than the surrounding sections, and do not have enough metal flow into the section to completely fill. The irregular and porous microstructure of the as-cast alloy results in poor and inhomogeneous mechanical properties of the alloy. Moreover, the as-cast Pd—In alloy has fine precipitations in primary crystals. Thus, the as-cast Pd—In alloy is brittle.

The thermomechanical processing step modifies the granular structure of the Pd—In alloy and significantly reduces the zones with columnar structure, the porosity and the crystallographic inhomogeneities. The cohesion and the mechanical strength of the thermomechanically processed Pd—In alloy are thus strongly increased.

In one aspect, the method further comprises a step of obtaining an injected component by injecting the thermomechanically processed Pd—In alloy into a die or a mold at an injection temperature that is above the heating temperature and below the liquidus temperature (homologous temperature). The injected component retains the improved structure of the thermomechanically processed Pd—In alloy. Re-initiating the crystallization process in the Pd—In alloy is avoided. The step of obtaining an injected component is particularly interesting for the manufacture of serial parts in jewelry or watchmaking.

Table 1 reports the composition of different components that were prepared by the method disclosed herein. The possible other elements contained in the Pd—In alloy at a maximum of 1.5 wt % are not reported in Table 1.

TABLE 1

| | Composition (wt %) | | | |
|---|---|---|---|---|
| Pd—In alloys | Pd | In | Al | Ru |
| 1H | 49.2 | 50.5 | — | 0.18 |
| 2A | 50.5 | 48.5 | 0.75 | 0.18 |
| 2B | 51.7 | 46.3 | 1.5 | 0.41 |
| 2E | 51.0 | 48.2 | 0.75 | — |
| 2F | 52.2 | 46.2 | 1.42 | — |
| 2ABCD | 49.2 | 49.0 | 0.1 | 0.49 |

Figure 1:
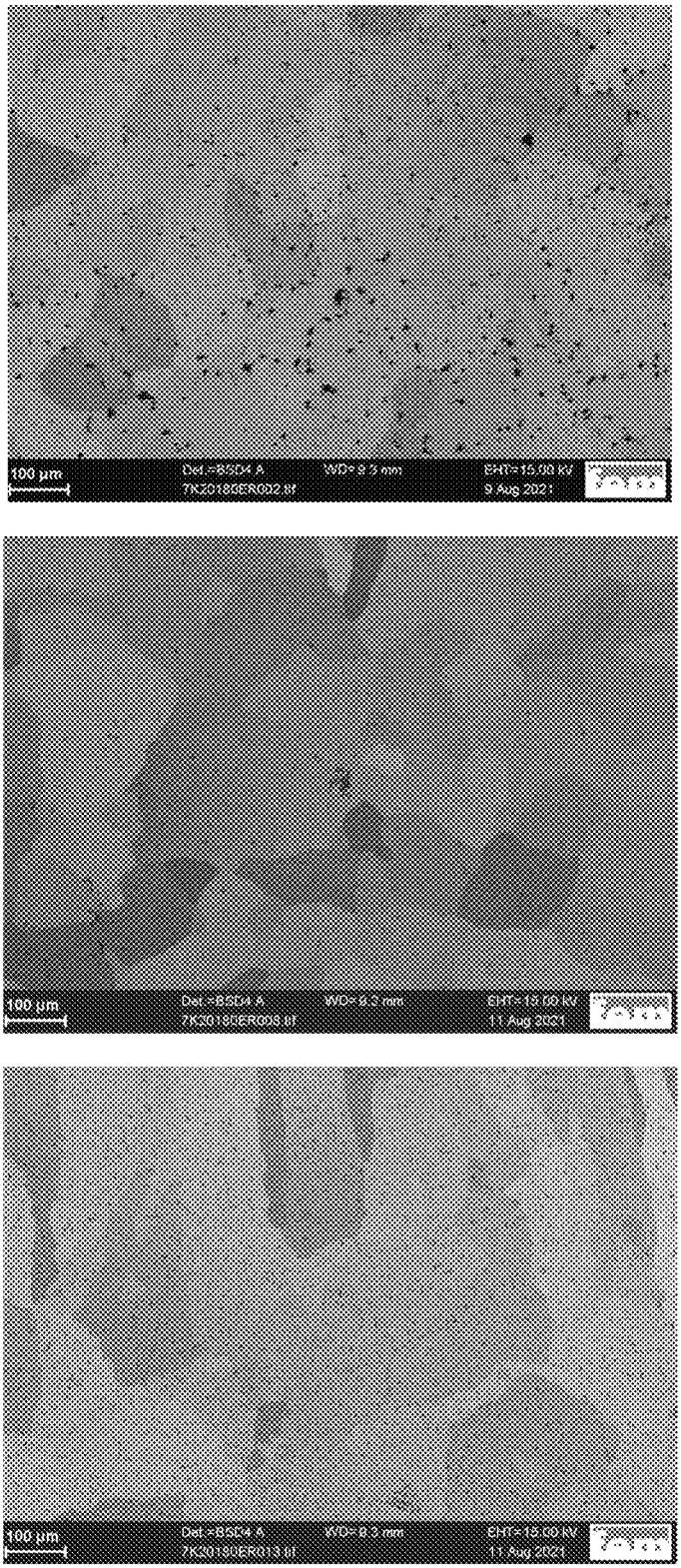
Figure 1:
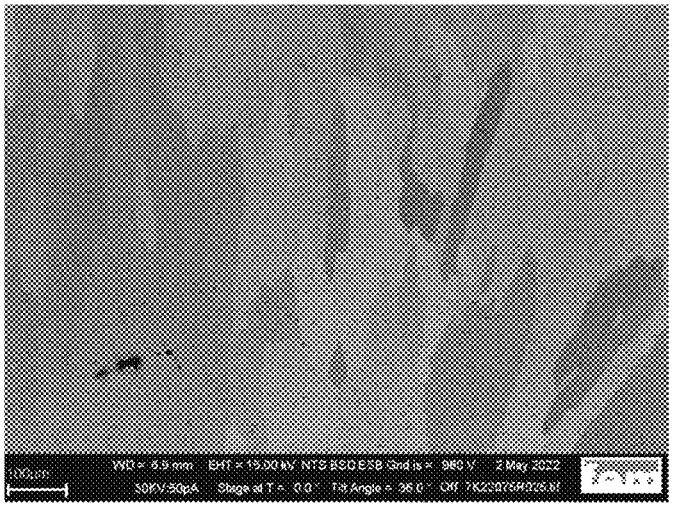
Figure 1:
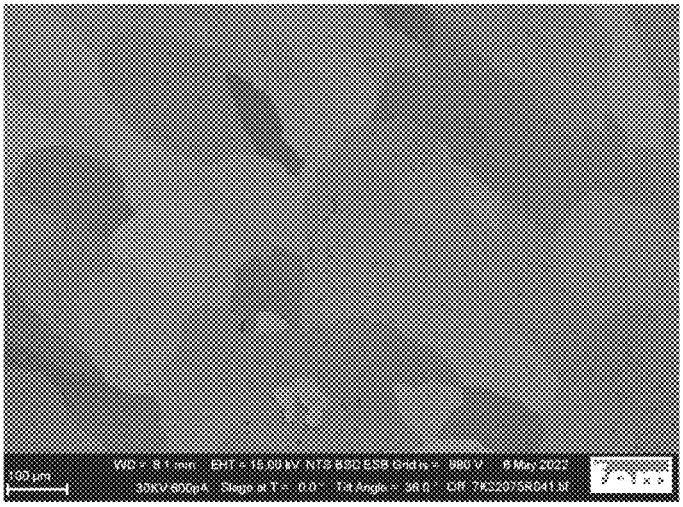
Figure 1:
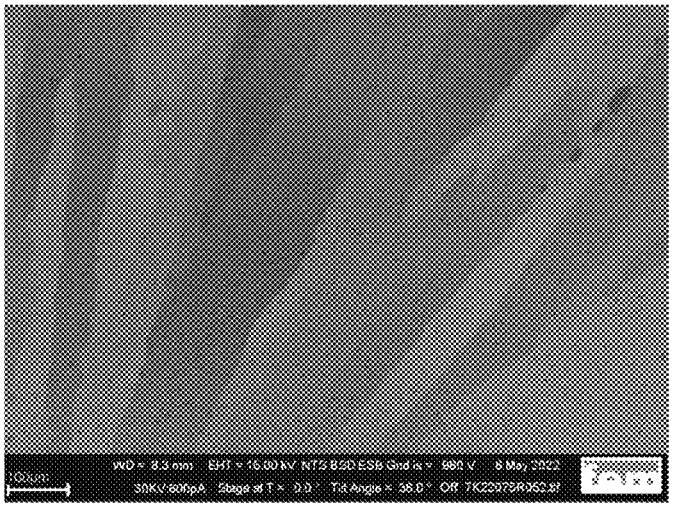

FIGS. 1*a-f* show SEM micrographs of metallographic cross sections of Pd—In alloys in the as-cast condition and made of a Pd—In alloy: 1H (FIG. 1*a*), 2A (FIG. 1*b*), 2B (FIG. 1*c*), 2ABCD (FIG. 1*d*), 2E (FIG. 1*e*), and 2F (FIG. 1*f*), showing the different microstructures depending on the composition. The different Pd—In alloys show a coarse-grained and irregular microstructure. The grain shapes are equiaxed (FIGS. 1*a*-1*c*, and 1*e*) or columnar (FIGS. 1*d* and 1*f*). Differences in the microstructure at the surface and the center of can be observed in the as-cast Pd—In alloys. Furthermore, the microstructure in the as-cast Pd—In alloys can show shrinkage porosity. Such irregular and porous structure has poor and inhomogeneous properties.

Figure 2:
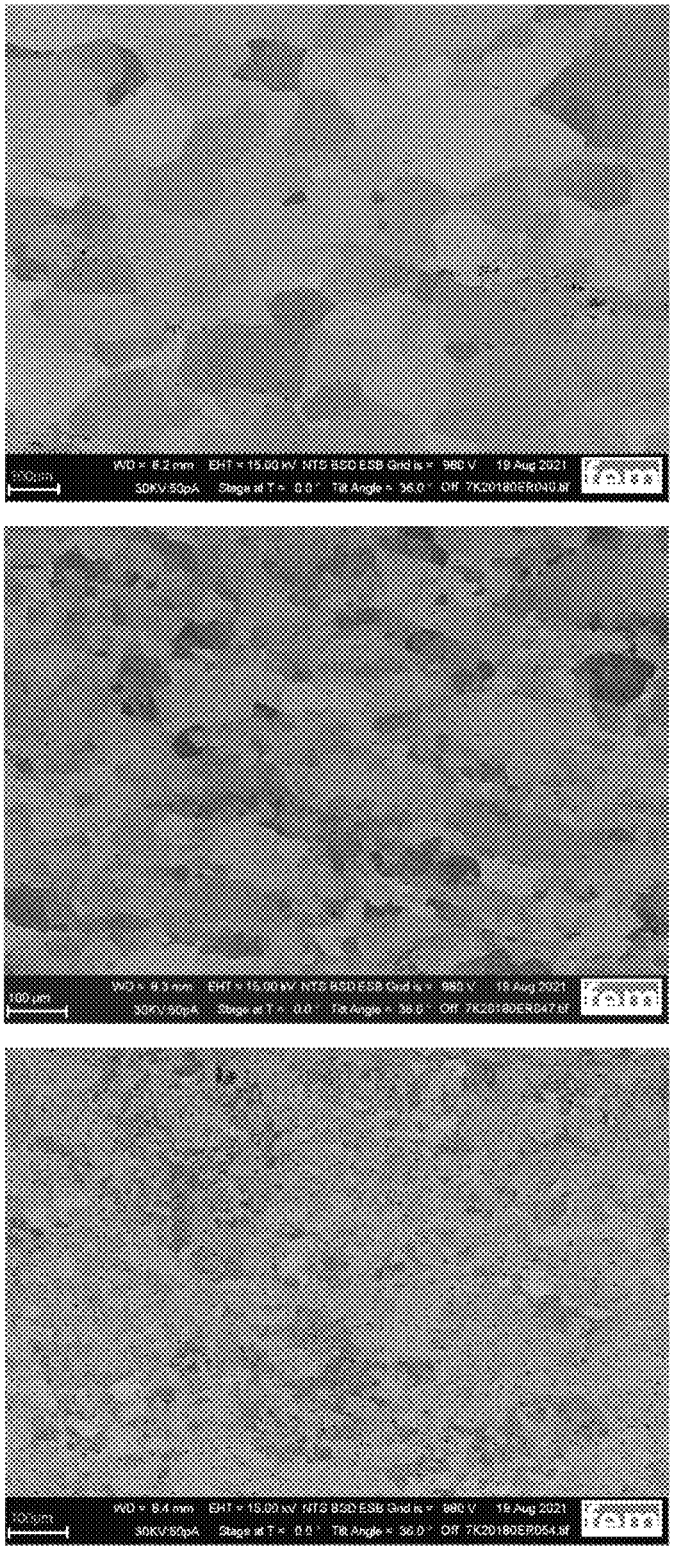
Figure 2:
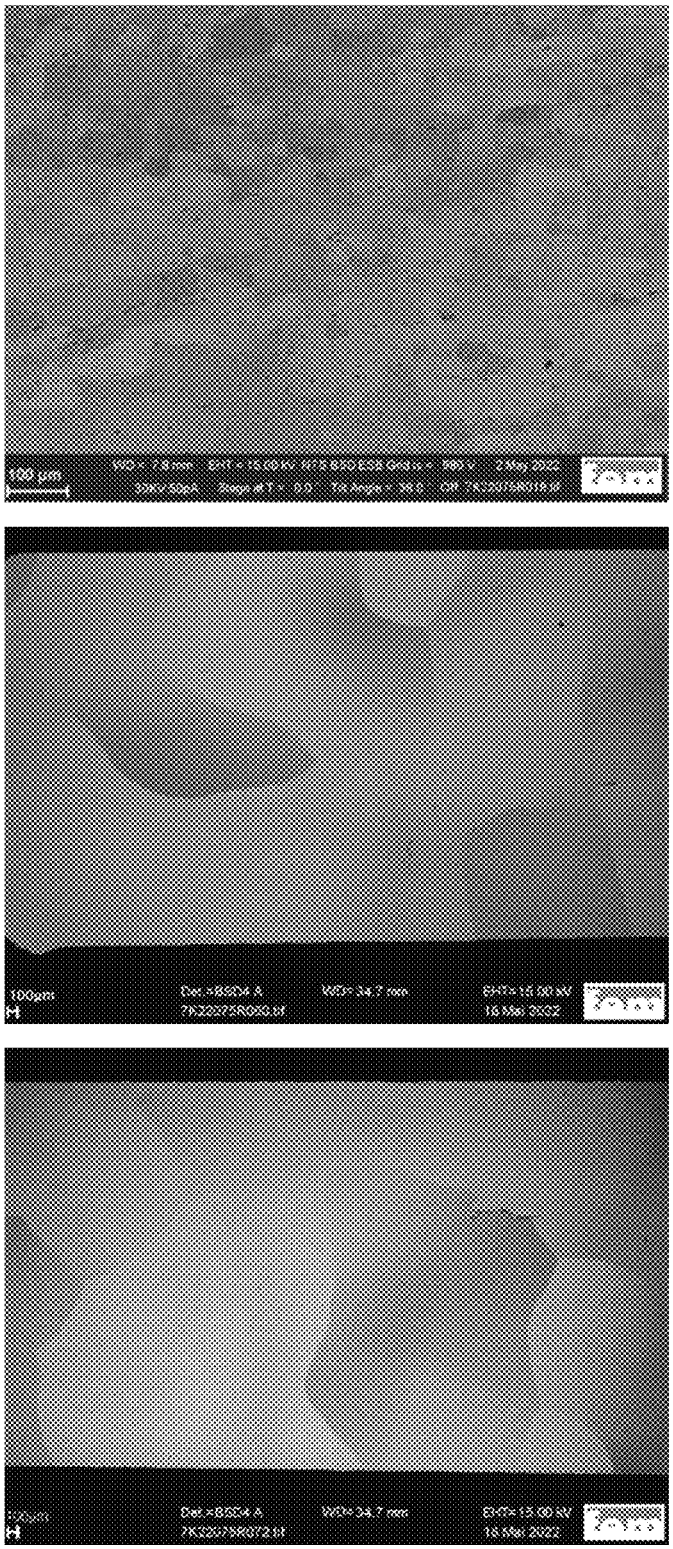

FIGS. 2*a-f* show SEM micrographs of metallographic cross sections of the components made of Pd—In alloys that have been submitted to the vacuum hot-pressing step at a heating temperature of 1100° C. More particularly, the different microstructures are shown for the component compositions: 1H (FIG. 2*a*), 2A (FIG. 2*b*), 2B (FIG. 2*c*), 2ABCD (FIG. 2*db*), 2E (FIG. 2*e*), and 2F (FIG. 2*e*). In the absence of Ru, the components 2E and 2F have large grain size (larger than 1000 μm). The presence of Ru in the alloy composition allows for decreasing the grain size. Components 1H, 2A, 2B and 2ABCD have grain size below 100 μm. More particularly, grain size between 30-50 μm was estimated for the component 2A, grain size of about 20 μm was estimated for the component 2B, grain size of about 100 μm was estimated for the component 1H, and grain size larger than 100 μm was estimated for the component 2ABCD. Component 2B comprising 1.5 wt % Al and 0.41 wt % Ru has the smallest grain size. The presence of Ru-precipitates in the Pd—In alloy inhibit grain growth.

The grain size of the components listed in Table 1 were estimated using optical microscopy and scanning electron microscopy (SEM) measurements of metallographic cross sections.

After performing the hot-pressing step, the component made of the Pd—In alloy has a modified microstructure. More particularly, the Pd—In alloy is deformed by the high heating temperature hot pressing step and recrystallizes. This results in a homogenization of the microstructure of the component (FIGS. 2*a-f*). The grains have similar size and regular shape. The columnar grains disappear, and the pores are closed such that the component has a porosity of less than about 1%. The composition of the Pd—In alloy also influences the microstructure of the component as discussed below.

Vacuum hot pressing significantly closes the shrinkage pores. Hot isostatic pressing can fully close the pores The hardness and the modulus of indentation were measured for the components listed in Table 1. The hardness was measured by using the hardness HV1 that corresponds to a Vickers hardness measured with a load of 1 kg (9,81 N) using the measurement method defined in ISO 6507. The modulus of indentation was measured by using instrumented indentation with 500 mN load, following the test specification DIN EN ISO 14577.

Table 2 reports the hardness HV1 and modulus of indentation measured of different components that were prepared by the method whereby the components were submitted to a vacuum hot-pressing step at a heating temperature of 1100° C.

Figure 3:
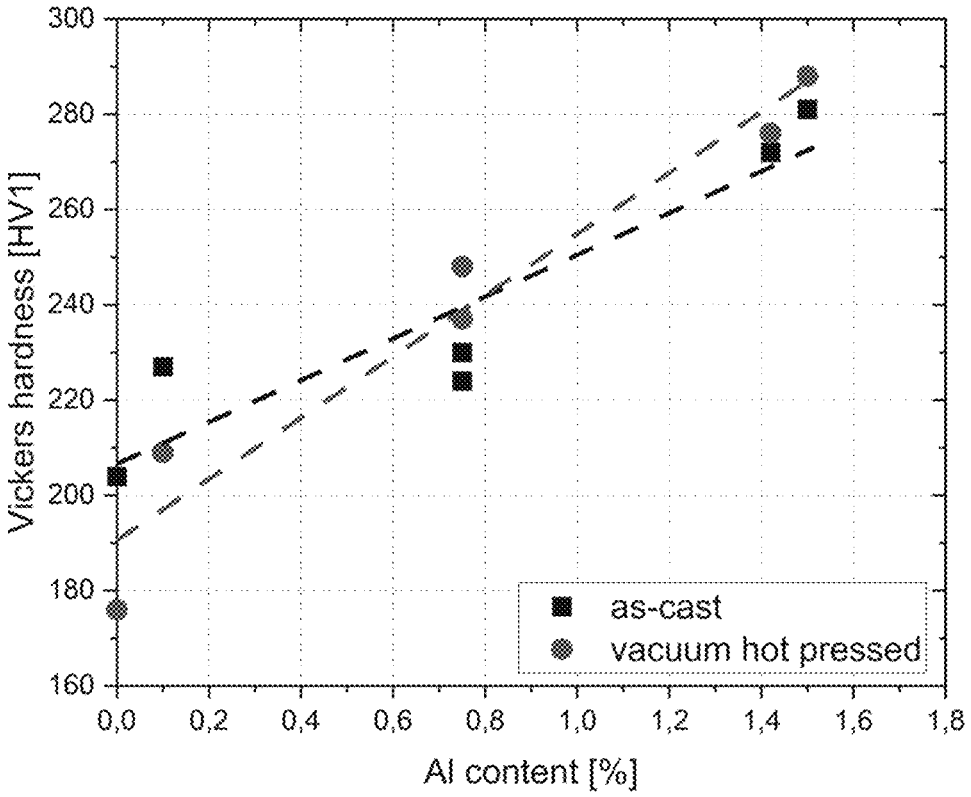
FIG. 3 shows a graph reporting the hardness HV1 as a function of the Al content in the Pd—In alloy.

FIG. 3 shows a graph reporting the hardness HV1 as a function of the Al content in the Pd—In alloy for the as-cast Pd—In alloy (squares) and for the component (circles). The measurements show that hardness HV1 increases linearly with increasing Al content for the as-cast Pd—In alloy and for the component. The hardness reaches a value of above 280 HV1 for Al contents of 1,5% or more for the as-cast Pd—In alloy and for the component. The modulus of indentation measurement remains unchanged.

TABLE 2

| | Hardness (HV1) | | Modulus of indentation (GPa) | |
|---|---|---|---|---|
| Sample | As cast | Hot pressed | As cast | Hot pressed |
| 1H | 204 | 176 | — | — |
| 2A | 224 | 248 | — | — |
| 2B | 281 | 288 | — | — |
| 2E | 230 | 237 | 109 | 104 |
| 2F | 272 | 276 | 108 | 112 |
| 2ABCD | 227 | 209 | 125 | 115 |

More generally, it has been found that for the component comprising between 46 and 56 wt % Pd, between 44 and 54 wt % In, and a maximum of 1.5 wt % of the other elements, after being subjected to the step of hot pressing, has non-columnar crystalline microstructure, and has a porosity of less than about 1%. The crystalline microstructure has grain size between 20 μm and 1000 μm.

The presence of Ag in the Pd—In alloy decreases the hardness and increases the ductility of the alloy. For example, the component comprising between 46 and 56 wt % Pd, between 44 and 54 wt % In, between 1 and 10 wt % Ag, and a maximum of 1.5 wt % of the other elements has a hardness of about 200 HV1

In contrast, the presence of Al in the Pd—In alloy increases the hardness of the alloy. For example, the Pd—In alloy comprising between 46 and 56 wt % Pd, between 44 and 54 wt % In, between 0.5 and 2 wt % Al, was shown to yield a hardness HV1 between 220 and 320 HV1.

The same component but comprising between 1.5 and 5 wt % Al has a hardness HV1 that is above 280 HV1.

The increased hardness observed for the component obtained by the present method can be due to anyone, or a combination, of: grain refinement (Hall-Petch-relationship), formation of a solid solution, precipitation, or/and dislocations. It should be noted that the hardness is not simply related to the grain size since solid solution, precipitates and dislocations can increase the hardness in coarse grains.

The presence of the grain refiner in the Pd—In alloy strongly decreases the grain size. Ru in the Pd—In alloy strongly decreases the grain size. The Pd—In alloy has homogeneous mechanical properties. For example, the Pd—In alloy comprising between 46 and 56 wt % Pd, between 44 and 54 wt % In, between 0.05 and 2 wt % Ru, and a maximum of 1.5 wt % of the other elements has grain size below 100 μm. In the absence of Ru, grain size strongly increases up to 1000 μm.

Figure 4:
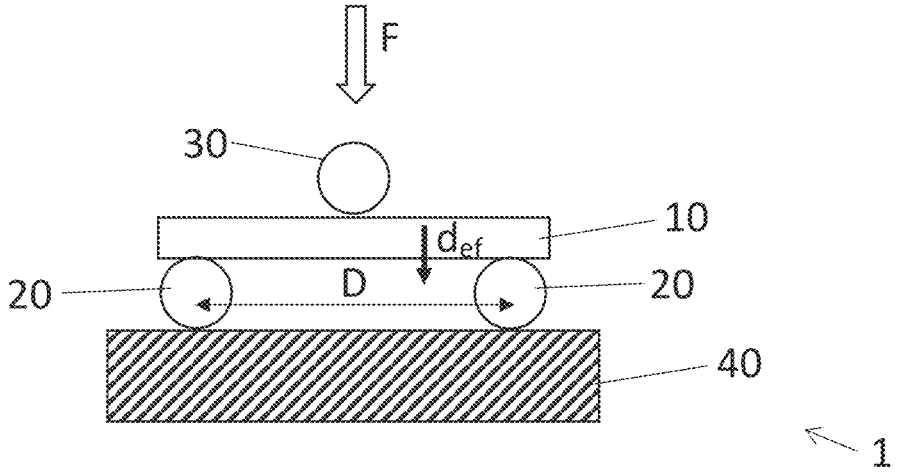
FIG. 4 illustrates a set-up of a bending test device.

Bending test using a three-point bending test according to DIN EN ISO 9693 were performed on test components made of 50.5 wt %, Pd, 48.5 wt % In, 0.8 wt % Al and 0.2 wt % Ru. In particular, the bending test were performed for three test components as-cast and three test components after the step of hot pressing under vacuum. The step of hot pressing under vacuum comprised forming the test component in a mold at 1100° C. FIG. 4 illustrates a set-up of the bending test device 1. The test component 10 is placed on two supporting pins 20 a set distance D apart, against a support 40, and is subject to a load F concentrated at its centre (exerted on a loading pin 30). The test components 10 were prepared in form of bars of about 3×3×25 mm and were loaded in the three-point bending test device 1 until breakage. The surface of each test component 10 was finely grounded to 1200 grain. FIG. 5 reports values for the maximum bending stress measured by using the three-point bending test according to DIN EN ISO 9693, as a function of the deflection $d_{ef}$ of the test components when the load F is applied on the test component. The bending stress is measured for three test components as-cast (No. 1-3) and three vacuum hot-pressed test components (No. 4-6), i.e., hot-pressed test components after the step of hot pressing under vacuum.

Table 3 reports the maximum bending force and maximum bending stress measured with the three-point bending test according to DIN EN ISO 9693 for three test components as-cast (No. 1-3) and three vacuum hot-pressed test components (No. 4-6). Table 3 shows that the maximum bending force and the maximum bending stress measured for the vacuum hot-pressed test components increase about three to four times compared to the maximum bending force and the maximum bending stress measured for the test components as-cast.

TABLE 3

| No | maximum bending force (N) | maximum bending stress (MPa) | cross-sectional area of test component |
|---|---|---|---|
| 1 | 137 | 13.4 | 9.80 |
| 2 | 264 | 28.5 | 8.81 |
| 3 | 162 | 17.4 | 9.33 |

TABLE 3-continued

| No | maximum bending force (N) | maximum bending stress (MPa) | cross-sectional area of test component |
|---|---|---|---|
| 4 | 679 | 70.4 | 9.21 |
| 5 | 687 | 73.6 | 9.30 |
| 6 | 869 | 93.4 | 9.30 |

When the alloy of the vacuum hot-pressed test component comprises 0.2 wt % Ru, the grains have homogeneous size and distribution and are non-columnar and their size varies between 100 μm and 500 μm. When the alloy of the vacuum hot-pressed test component comprises 0.5 wt % Ru, the grains have a size of 50 μm and without Ru the size was up to 1 mm.

The test components made of 50.5 wt %, Pd, 48.5 wt % In, 0.8 wt % Al and 0.2 wt % Ru corresponds to a hardened alloy, but embrittled by the presence of aluminum. In the absence of aluminum, the improvement in bending strength is superior because the alloy is less brittle, less hard and more ductile.

It should be noted that the exemplary Pd—In alloy composition containing 0.8 wt % Al and 0.2 wt % Ru as described above and in Table 3 corresponds to a hardened alloy embrittled by the presence of aluminum. This exemplary alloy composition is used in the description as a "worst case example" to show that, even for such an embrittled alloy, the claimed thermomechanically process allows for increasing the maximum bending force and the maximum bending stress by a factor of three to four times compared to that measured for the components as-cast. In the absence of aluminum, the improvement in bending strength should be superior because the alloy is less brittle, less hard and more ductile.

Table 4 reports values of the deformation ratio for some Pd—In alloys submitted to the thermomechanical processing. The deformation ratio can be defined as the ratio of the initial lateral size of the component, prior thermomechanically processing the component, to the final lateral size of the component after thermomechanically processing the component.

In Table 4, the component prior thermomechanically processing the component is cylinder-shaped. The values reported under the label "cylinder-cylinder" correspond to the cylinder-shaped component being pressed along its length such that the initial and final lateral size corresponds to the height of the cylinder. The values reported under the label "cylinder-plate" correspond to the cylinder-shaped component being pressed along its diameter such that the initial lateral size is the cylinder diameter, and the final lateral size is the thickness of the pressed component. The thermomechanical processing comprises a step of hot pressing under vacuum (VHP), performed at a heating temperature between 1050° C. and 1150° C., and at controlled deformation rate of 0.1 to 10 mm/h with an applied load between 10 and 100 MPa, and with an applied load between 1 and 500 MPa.

In the case the component, the initial lateral size can be the diameter of the cylindrical-shaped unprocessed component. Then, the final lateral sizes can be the thickness. The initial and final lateral sizes can be the thickness of the component or the height of the component (for example, in the case of a cylindrical component that is pressed along its length).

TABLE 4

| Alloy | | | | | |
|---|---|---|---|---|---|
| Pd w-% | In W-% | Al W-% | Ru W-% | Component | deformation ratio |
| 50.5 | 49 | 0 | 0.5 | cylinder-cylinder | 1.84 |
| 50.5 | 49 | 0 | 0.5 | | 3.51 |
| 50.5 | 49 | 0 | 0.5 | | 10.21 |
| 50.5 | 48.5 | 0.8 | 0.2 | cylinder-plate | 3.20 |
| 51.7 | 46.3 | 1.5 | 0.5 | | 2.56 |

In an embodiment, the component made of the Pd—In alloy comprising between 46 and 56 wt % Pd, between 44 and 54 wt % In, between 0 and 10 wt % of Ag, Au, Cu, Pt, Si, or Sn, or a combination of these elements, between 0 and 2 wt % of Ru, Rh, Re, or Ir, between 0 and 5 wt % of Al, and a maximum of 1.5 wt % of other elements (called hereafter optimal component alloy).

The optimal component alloy is submitted to a thermomechanical processing comprising a step of hot pressing under vacuum, hot pressing under a protective gas, or hot isostatic pressing (HIP), performed at a heating temperature between 1050° C. and 1150° C., and at controlled deformation rate of 0.1 to 10 mm/h with an applied load between 10 and 100 MPa, and with an applied load between 1 and 500 MPa. The thermomechanical processing is further performed with a deformation ratio between 1.2 and 15. The above thermomechanical processing is called hereafter optimal thermomechanical processing.

The bending test using a three-point bending test according to DIN EN ISO 9693 yields a maximum bending force and the maximum bending stress that is at least four times greater than the maximum bending force and the maximum bending stress using the same bending stress for the Pd—In alloy in the as-cast condition. The high maximum bending force and maximum bending stress reflect the high ductility, flexibility, and bending strength of the component, and thus the workability of the component.

The optimal component alloy, when thermomechanically processed with the optimal thermomechanical processing, allows for homogenizing the microstructure of the component such that the grains of the Pd—In alloy have similar size and regular shape. The Pd—In alloy have has a non-columnar crystalline microstructure and has a porosity of less than 1%. Moreover, the Pd—In alloy has good workability at room temperature and at moderate load, without cracking.

Thus, the optimal component alloy thermomechanically processed with the optimal thermomechanical processing is characterized by a bending force and bending stress being at least higher than twice that of the Pd—In alloy in the as-cast condition, and possibly a higher bending force and bending stress depending on the possible variations of composition of the Pd—In alloy of the optimal component alloy, and the possible variations of the heating temperature, deformation rate, and applied load in the optimal thermomechanical processing.

It has been shown that a deformation ratio of 2.5 allows for achieving the porosity of less than 1% in the optimal component alloy. The deformation of the component during the optimal thermomechanical processing makes it possible to change the alloy's properties, in particular its structure. After the optimal thermomechanical processing, the component alloy has homogenized alloy structure and reduced grain size. The component has significantly increased flexural and tensile strength and has good machinability.

The deformation ratio can be above 30, demonstrating that the optimal thermomechanical processing can provide the component having a very high ductility. This shows the unexpected effects on the component properties that can be achieved with the optimal thermomechanical processing disclosed herein.

In an embodiment, the component made of the optimal component alloy can be thermomechanically processed with the optimal thermomechanical processing with a deformation ratio between 1.2 and 10. Optimal mechanical properties of the component can be obtain with a deformation ratio between 1.2 and 15 or 1.8 and 15 or between 5 and 15.

The component made of the optimal component alloy and submitted to the optimal thermomechanical processing has a porosity of less than 1%, a homogenized alloy structure with grain size smaller than 50 μm or smaller than 20 μm, high flexural and tensile strength and has good machinability.

The optimal thermomechanical processing can further comprise injecting the component made of the optimal component alloy and having been submitted to the optimal thermomechanical processing into a die or a mold at an injection temperature that is between 1050° C. and 1150° C. The step of obtaining an injected component is particularly interesting for the manufacture of serial parts in jewelry or watchmaking.

Color properties of the component were measured by using the CIE Standard Illuminant D65 and a 10° observer (hereafter D65/10) on metallographically polished sample of the component. In the L*a*b* color space, L stands for lightness, a* is the green/red axis, and b* is the blue/yellow axis.

The color difference (Delta E or ΔE) is the difference between two colors designated as two points in the Lab color space. A ΔE value smaller than 0.5 corresponds to almost imperceptible difference, a ΔE value between 1 and 2 corresponds to a slight color difference, a ΔE value between 2 and 4 corresponds to perceived color difference, while a ΔE value greater than 5 corresponds a different color. Table 5 reports the color values measured for the different components reported in Table 1. The ΔE value is determined by reference with component 1H.

TABLE 5

| | Color values | | | |
|---|---|---|---|---|
| Sample | L* | a* | b* | ΔE |
| 1H | 73.86 | 9.84 | 10.42 | — |
| 2A | 74.04 | 9.73 | 8.77 | 1.66 |
| 2B | 74.88 | 9.49 | 9.63 | 1.33 |
| 2E | 74.46 | 9.73 | 9.17 | 1.39 |
| 2F | 74.77 | 9.51 | 10.43 | 0.96 |
| 2ABCD | — | — | — | — |

The component can have a color in the CIELAB color space of L* between 73 and 75, a* between 9.4 and 9.8, and b* between 9 and 10.5.

The component obtained by the method has a good workability at room temperature and at moderate load. The component shows no cracking or sample failure. Moreover, the component shows no oxidation.

In an embodiment, the component obtained by the method can constitute, completely or in part, a watch part, such as a case, a dial, a plate, a bridge, an oscillating weight, etc.

The component obtained by the method can further constitute, completely or in part, a piece of jewelry, such as a piercing, an earring, a finger-ring, a bracelet, a wrist-watch link, etc. The component can further constitute, completely or in part, a decorative component, such as a brooch, a medal, a badge, etc.

The component can further constitute, completely or in part, a component for medical applications.

The invention claimed is:

1. A method for obtaining a component made of a palladium (Pd)-indium (In) alloy comprising between 46 and 56 wt % Pd, between 44 and 54 wt % In, between 0 and 10 wt % of silver (Ag), gold (Au), copper (Cu), platinum (Pt), silicium (Si), or tin (Sn), or a combination of these elements, between 0 and 2 wt % of any one of: ruthenium (Ru), rhodium (Rh), rhenium (Re) or iridium (Ir), between 0 and 5 wt % of aluminum (Al), and a maximum of 1.5 wt % of other elements; the method comprising:

providing the Pd—In alloy;

thermomechanical processing the Pd—In alloy, comprising a step of hot pressing under vacuum, hot pressing under a protective gas, or hot isostatic pressing;

wherein the thermomechanical processing is performed at a heating temperature between 1050° C. and 1150° C., at controlled deformation rate of 0.1 to 100 mm/h with an applied load between 1 and 500 MPa; and wherein the thermomechanical processing is performed with a deformation ratio between 1.2 and 15, the deformation being defined as the ratio of the initial lateral size of the component, prior thermomechanically processing the component, to the final lateral size of the component after thermomechanically processing the component;

wherein the thermomechanically processed Pd—In alloy has a bending stress measured with a three-point bending test, according to DIN EN ISO 9693 until breakage that is at least four time greater that the bending stress of as-cast the Pd—In alloy measured with the same three-point bending test.

2. The component according to claim 1, wherein the Pd—In alloy comprises between 1 and 10 wt % silver (Ag) or between 0.1 and 5 wt % aluminum (AI).

3. The method according to claim 1, wherein the Pd—In alloy comprises between 0.5 and 2 wt % Al and has a hardness HV1 between 220 and 320 HV1, or between 1.5 and 5 wt % Al and has a hardness HV1 above 280 HV1;

wherein hardness HV1 is measured with a load of 1 kg (9,81 N) using the measurement method defined in ISO 6507.

4. The method according to claim 1, wherein the Pd—In alloy comprises between 0.1% and 2% wt % Ru;

wherein the Pd—In alloy has grain size between 20 μm and 100 μm;

wherein the grain size is measured using optical microscopy and scanning electron microscopy (SEM) measurements of metallographic cross sections.

5. The method according to claim 1, wherein the Pd—In alloy comprises between 0.1% and 0.5% wt % Ru.

6. The method according to claim 1, wherein the Pd—In alloy comprising between 49.2% and 52.2% wt Pd, 46.2 and 50.5% wt In, between 0 and 1.42% wt Al, between 0 and 0.49% wt Ru, and a maximum of 1.5 wt % of other elements has a color in the CIELAB color space of L* between 73 and 75, a* between 9.4 and 9.8, and b* between 9 and 10.5;

wherein color was measured by using the CIE Standard Illuminant D65 and a 10° observer on metallographically polished sample of the component.

7. The method according to claim 1, wherein the Pd—In alloy is a Pd500 alloy.

8. The method according to claim 1, wherein the hot-pressed alloy is extruded by passing it through a die such as to form a wire having a diameter between 1 and 5 mm.

9. The method according to claim 1, wherein the hot-pressing step is performed at controlled deformation rate of 0.1 to 10 mm/h, and more specifically 0.5 to 2 mm/h.

10. The method according to claim 1, wherein the component is a watch component or part of a watch component.

11. The method according to claim 1, wherein the component is a component or part of a component for medical, for jewelry, or decorative applications.

* * * * *